US007982587B1

(12) United States Patent
Thanhauser et al.

(10) Patent No.: US 7,982,587 B1
(45) Date of Patent: Jul. 19, 2011

(54) INTEGRATED MICROPROCESSOR CONTROLLED ALARM

(75) Inventors: Albert S. Thanhauser, Riverdale, NY (US); Russell W. Sherwood, Olathe, KS (US)

(73) Assignee: Longwood Corporation, Riverdale, NY (US)

( * ) Notice: Subject to any disclaimer, the term of this patent is extended or adjusted under 35 U.S.C. 154(b) by 424 days.

(21) Appl. No.: 12/184,702

(22) Filed: Aug. 1, 2008

Related U.S. Application Data

(60) Provisional application No. 61/030,294, filed on Feb. 21, 2008.

(51) Int. Cl.

| | |
|---|---|
| ***G08B 1/00*** | (2006.01) |
| ***G04B 23/02*** | (2006.01) |
| ***G04B 25/04*** | (2006.01) |
| ***G04C 21/16*** | (2006.01) |

(52) U.S. Cl. ..... 340/309.16; 368/244

(58) Field of Classification Search ..... 340/425.5, 340/426.34, 426.24, 426.26, 480, 500, 501, 340/692, 384.1, 384.6, 388.1, 391.1, 438; 116/2, 56, 59, 142 R, 149; 368/11, 110, 368/121, 243–245

See application file for complete search history.

(56) References Cited

U.S. PATENT DOCUMENTS

| | | | | |
|---|---|---|---|---|
| 3,173,136 | A | 3/1965 | Atkinson | |
| 3,934,085 | A | 1/1976 | Munson | |
| 4,603,317 | A | 7/1986 | Gailbreath | |
| 5,050,142 | A * | 9/1991 | Gibbs | 368/11 |
| 5,771,180 | A * | 6/1998 | Culbert | 702/130 |
| 5,844,862 | A * | 12/1998 | Cocatre-Zilgien | 368/10 |
| 6,323,759 | B1 * | 11/2001 | Menze | 340/425.5 |
| 6,940,395 | B2 * | 9/2005 | Steinmark | 340/309.16 |
| 7,071,816 | B2 * | 7/2006 | Tewell et al. | 340/384.1 |
| 7,245,226 | B1 | 7/2007 | Thanhauser et al. | |
| 7,324,013 | B2 * | 1/2008 | Esson | 340/903 |
| 2002/0114221 | A1 * | 8/2002 | Stahl | 368/73 |
| 2005/0128073 | A1 * | 6/2005 | Coons et al. | 340/539.1 |
| 2006/0017579 | A1 * | 1/2006 | Albert et al. | 340/628 |
| 2006/0083112 | A1 * | 4/2006 | Sim et al. | 368/10 |
| 2009/0154299 | A1 * | 6/2009 | Solhjoo et al. | 368/108 |

* cited by examiner

*Primary Examiner* — Jennifer Mehmood
(74) *Attorney, Agent, or Firm* — Sturm & Fix LLP

(57) ABSTRACT

Alarms are often required on various vehicles and equipment such as fork lifts, dump trucks, bulldozers, etc. An alarm is disclosed controlled by a microprocessor, which is an integral part of the basic circuit. The microprocessor is relied upon for adjusting alarm output based on source voltage, time of day, ambient noise, ambient frequencies, and ambient temperature. Additional features include sensing the alarm's own output to adjust alarm output in a feedback control loop, alarm self diagnosis using a current sensor, and using the microprocessor to operate a digital radio, such as Bluetooth, for intelligent alarm communication into a monitoring system for vehicle alarm status.

1 Claim, 5 Drawing Sheets

INTEGRATED MICROPROCESSOR CONTROLLED ALARM

CROSS REFERENCE TO RELATED APPLICATIONS

This invention includes improvements to U.S. Pat. No. 7,245,226, entitled "Integrated Microprocessor Controlled Alarm", issued Jul. 17, 2007. This invention was disclosed in U.S. Provisional Application No. 61/030,294, and claims the priority benefit thereof.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of alarms, and more particularly to a microprocessor controlled alarm having commercially significant improvements.

2. Background Art

Alarms are used on mobile machinery and vehicles to warn persons of the danger they may present. Such machinery is used in construction, mining, industrial, and warehouse applications, for instance. Some alarms are sounded only when the vehicle is backed up. An operator of such machinery, such as a fork lift, back hoe, crawler, etc., is subject to the noise of the alarm. Conventional alarms have no particular protection for the operator from intense sound. As a consequence, alarms are often disabled by operators so as to alleviate themselves of the discomfort caused by the noise.

As can be seen by reference to U.S. Pat. No. 7,245,226, which is hereby incorporated by reference, and the cited references, the prior art is replete with myriad and diverse alarms. Some examples can be found in U.S. Pat. No. 3,173,136 by Atkinson, U.S. Pat. No. 3,934,085 by Munson et al., and U.S. Pat. No. 4,603,317 by Gailbreath, et al.

While all the aforementioned prior art constructions are adequate for the basic purpose and function for which they have been specifically designed, they may be made more commercially appealing by the addition of various features.

There exists a need for new and improved integrated microprocessor controlled alarms and the provision of any and all such construction is a stated objective of the present invention.

BRIEF SUMMARY OF THE INVENTION

The present invention is a warning alarm. It may be used in many applications where sonic annunciation is desired, and has capability for visual alerts such as a strobe. It may be used to warn of imminent machine activity which could pose physical hazards to nearby persons. Such alarms have a broad range of requirements for sound output level, generated tone character, environmental stability, and cost.

The alarm of the present invention incorporates a microprocessor, providing all the functions normally provided by circuitry used in the prior art, as well as increased reliability. The microprocessor may be programmed to achieve the functions associated with a commercial alarm of this type. The microprocessor control element eliminates the need for variable amplifiers and different control circuits for varying applications, while further producing previously unachievable alarm characteristics and functions. Simple changes in programming provide functionality for different alarm applications.

A purpose of this invention is to provide a real time clock by which to modify an alarm signal based on the time of day. For instance, an alarm signal volume may be reduced if the alarm is located or used near residential areas.

Another purpose is to measure frequencies of ambient noise and choose alarm frequency or frequencies so the alarm is differentiable from the ambient noise. A frequency analysis, such as a Fast Fourier Transform (FFT), is carried out on the sensed ambient signal. Dominant frequencies are observed from this analysis and the alarm signal frequency chosen to be different from those frequencies by one-third octave or more. In such case the alarm would not need to be louder than ambient noise level in order to be differentiable. The existing diaphragm within the alarm hardware may be used for a microphone to sense the ambient noise.

Another object is to compensate for varying alarm performance due to ambient temperature. For this purpose, an ambient temperature sensor is provided and its signal passed to a microprocessor where the alarm signal can be modified as a function of the ambient temperature.

Another object of the present invention is to use the microprocessor in a self diagnostic mode to verify alarm nominal function. A current sensor is used to implement this feature.

Another object is to operate a digital radio with the microprocessor for intelligent alarm communication monitoring system for vehicle alarm status. An example of a viable protocol for the digital radio is Bluetooth, however, the present invention is not limited to a particular digital radio protocol. Features of such a digital radio system include wireless, short-range data transmission with low power consumption to connect multiple devices and the ability to synchronize those devices.

Another object is to monitor, using the microprocessor, the alarm use and expected end of life to anticipate alarm wear out time. This information can be used so replacement can be made prior to failure. This helps prevent potential non-working alarm hazards. Monitoring may be via a lower power digital radio such as Bluetooth connected to a remote monitor such as a personal computer.

Another object is the use of the microprocessor to provide alarm unique digital ID, such as a serial number and date of manufacture, for warranty and life expectancy information.

A final object of the present invention is the use of the microprocessor to provide a custom alarm based on a customer's application, needs, requirements, and wishes. Factory or field reprogramming of the alarm for new and alternate operation may include: (A) new alarm signal; (B) new alarm features and parameters; (C) new alarm operational software; and (D) specialized customer specific features.

The microprocessor alarm system would be coupled to a transducer having a broad, useful frequency range. An illustration of this transducer can be seen in FIG. 1. The diaphragm assembly shown is constructed of metallic materials and are thermally coupled to one another. This permits very high power handling because of large surfaces in contact with air. The diaphragm, circuit board and magnet fit neatly into an inexpensive plastic housing and the diaphragm is held in place by foam or rubber O-rings by the front housing extension within the plastic housing. Other types of transducer would be used in similar fashion.

The transducer is also used as a detector by the microprocessor and can be used to measure ambient sound and adjust alarm volume and/or frequency output accordingly.

In this embodiment the electronics would fit into the end of the housing opposite the extension, and would be attached to the magnet. The housing rear cover holds the electronic printed circuit board and magnet in place. The housing is made from an inexpensive plastic such as PVC or ABS, glued or welded together. This housing, when assembled, becomes a sealed and environmentally stable package for the entire alarm.

The resulting alarm system is a highly integrated, reliable, low cost, programmable alarm, meeting the high-output, low-voltage alarm requirements of such alarm devices. Software control permits fulfillment of unforeseen future applications by simple programming changes without redesign. Low component count ensures low cost and increased reliability. Controlled acoustic radiation pattern and acoustic output level enhances human perception and localization of the alarm without interference to machine operators.

The novel features which are believed to be characteristic of this invention, both as to its organization and method of operation together with further objectives and advantages thereto, will be better understood from the following description considered in connection with the accompanying drawings in which a presently preferred embodiment of the invention is illustrated by way of example.

DETAILED DESCRIPTION OF THE INVENTION

Figure 1:
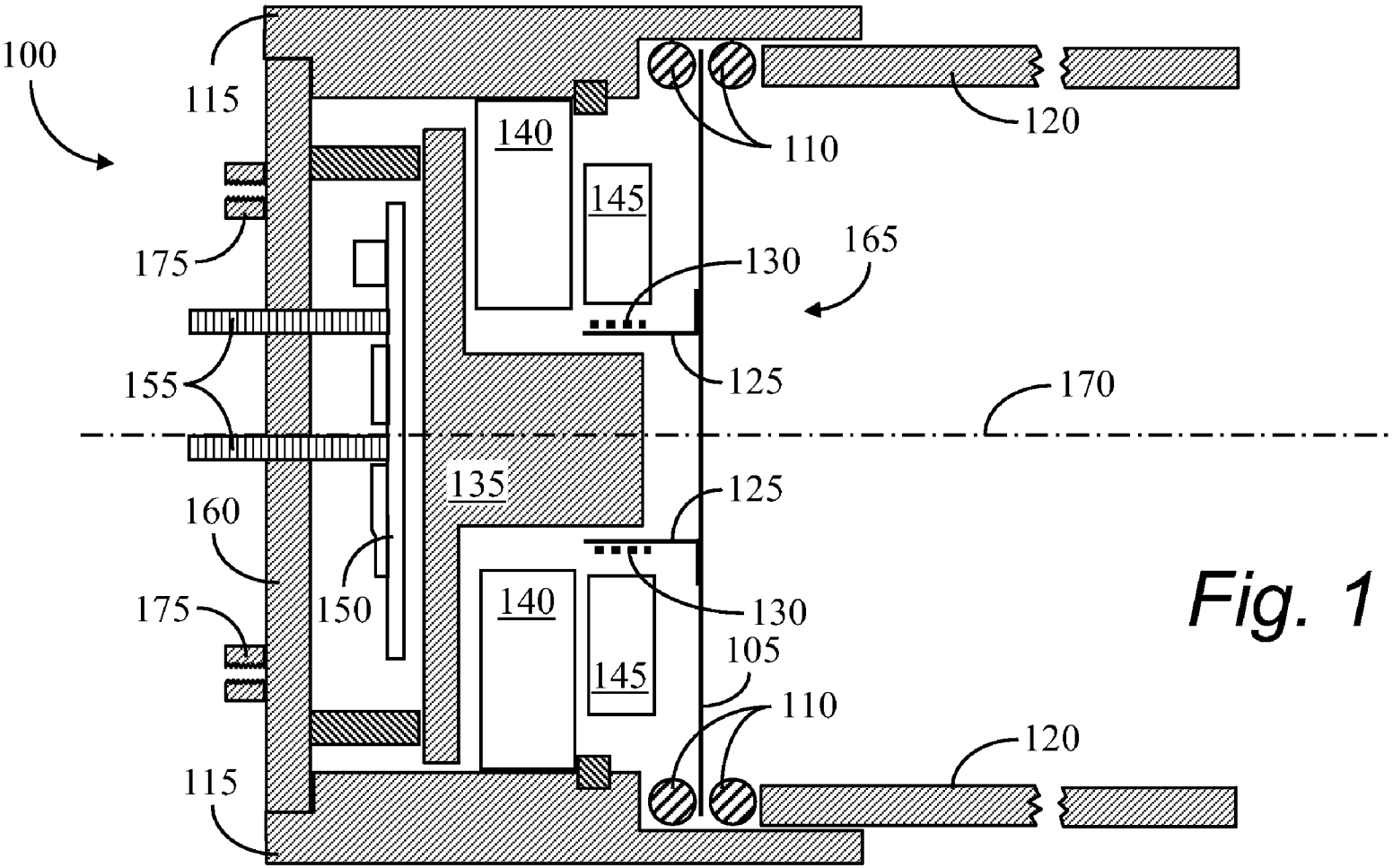
FIG. 1 is a cutaway view of a first embodiment of the alarm system of the present invention.

The present device makes use of a flat-plate diaphragm 105 as a major vibrating component of the completed alarm 100, as shown in FIG. 1. The diaphragm 105 is sandwiched between two O-rings 110 of elastic material such as rubber or foam. The O-rings, in turn, are held in place between the main housing 115 and the extension housing 120. The main housing 115 and the extension housing 120 are fused together using standard plastic to plastic glues or chemical weld.

A voice coil former 125 is rigidly affixed to the diaphragm 105 and is wound by the voice coil wires 130. A pole piece 135 is inserted into the center of the voice coil former 125. A magnet 140 provides the necessary permanent electromagnetic force while a top plate 145 structurally connects the magnet 140 and pole piece 135.

A printed circuit board 150 also resides in the main housing 115 for protection from the elements. The power to the printed circuit board 150 comes through connectors 155. A back cover 160 seals the electronics from dust and moisture outside the housing. Accommodations for threaded fasteners such as standoffs 175 or the like may optionally be provided to mount a strobe or similar visible alarm to the back of the alarm system 100.

The main housing 115, extension housing 120, diaphragm assembly 165, magnet 140, pole piece 135, top plate 145, and the back cover 160 are all symmetric about an axis of rotation 170.

In operation, the diaphragm 105 is vibrated by the interaction of a current through the voice coil wires 130, the voice coil former 125, the pole piece 135, and the diaphragm 105. The resulting alarm or voice sound waves travel through the extension housing 120, being focused to a predetermined region.

By gluing or welding the main housing 115, back cover 160, and extension housing 120 together, the alarm unit 100 is sealed from moisture and dirt outside the alarm system 100. It also provides the option of introducing a ferro fluid to the inside of the alarm housing to enhance cooling in high energy applications.

Figure 2:
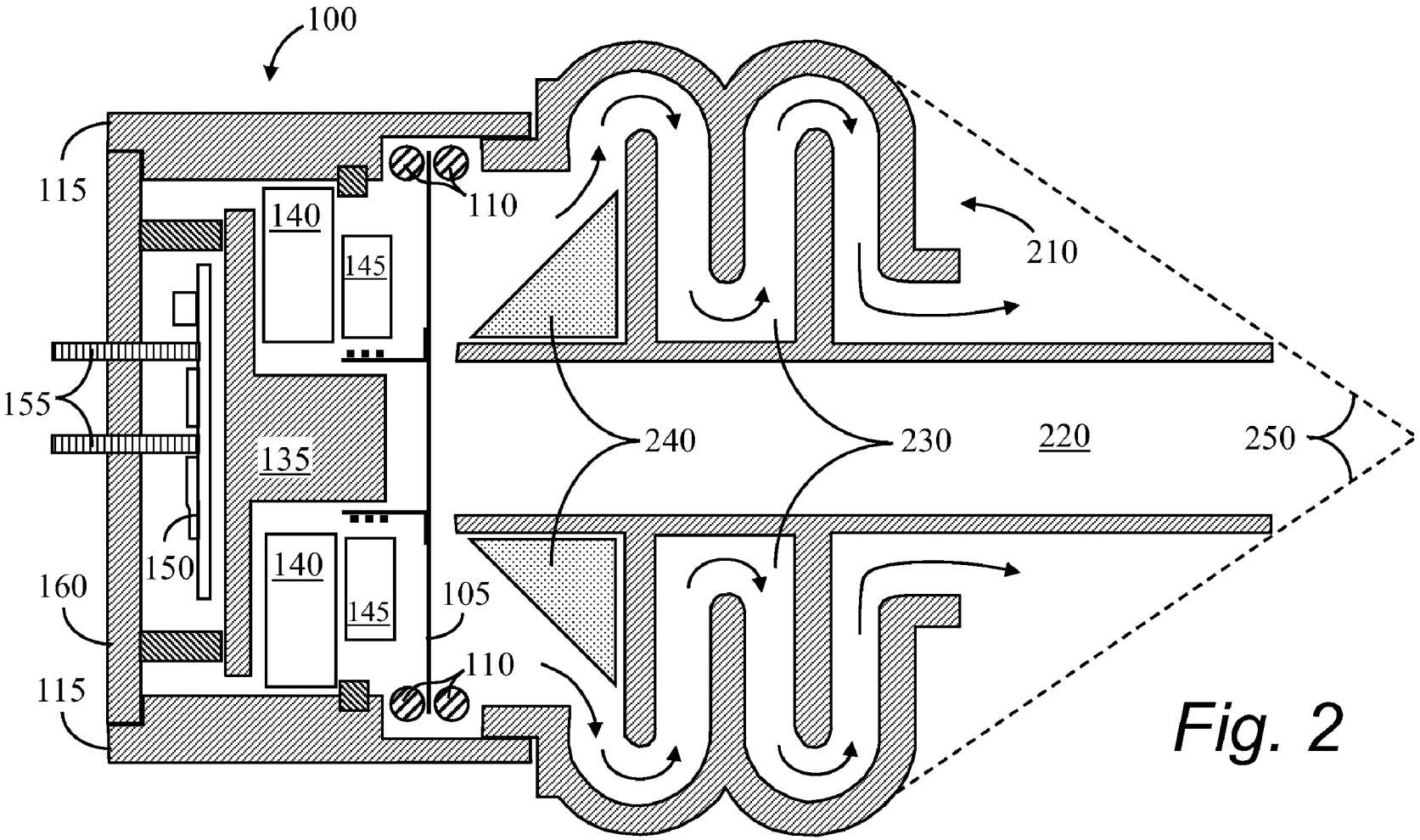
FIG. 2 is a cutaway view of a second embodiment of the alarm system of the present invention.

Another embodiment of the present alarm 100 is shown in FIG. 2, wherein only the extension housing 120 has been replaced. Instead of the extension housing 120, an acoustic lens 210 focuses the sound waves into an appropriate pattern. As with the extension housing 120, the acoustic lens is axisymmetric.

The vibrating diaphragm moves left to right causing sound to be radiated to the right in the drawing. There are two paths for the sound to follow. A center path 220 is a straight tube and provides a short path for sound to be radiated which is generated by the central portion of the diaphragm 105. An outer path 230 contains a plurality of switchbacks to create a longer path. A switchback is defined, herein, as a path wherein the sound changes radial direction. The radial direction is in reference to the axis to which the acoustic lens 210 is axisymmetric. The sound following the outer path 230 is generated by the outer portion of the diaphragm 105 which may be considered a ring. The acoustic lens 210 is not an impedance transformer as a horn, nor is it a resonator. The two different paths 220, 230 are intended to have equal energy of radiation at their respective outputs. The difference in physical position of the two outputs, when combined with the delay time between the two outputs, causes the radiation pattern to become unidirectional in character.

A filler block 240 is to direct the sound waves from the diaphragm 105 into the outer path 230. The filler block 240 improves the characteristics of the acoustic energy flow which reduces losses.

A nose cone 250 covers the output side of the acoustic lens 210. The nose cone 250 is a thin, perforated cone of metallic material which provides mechanical protection from direct blast of water and nesting of insects to the working parts of the alarm 100.

Figure 3:
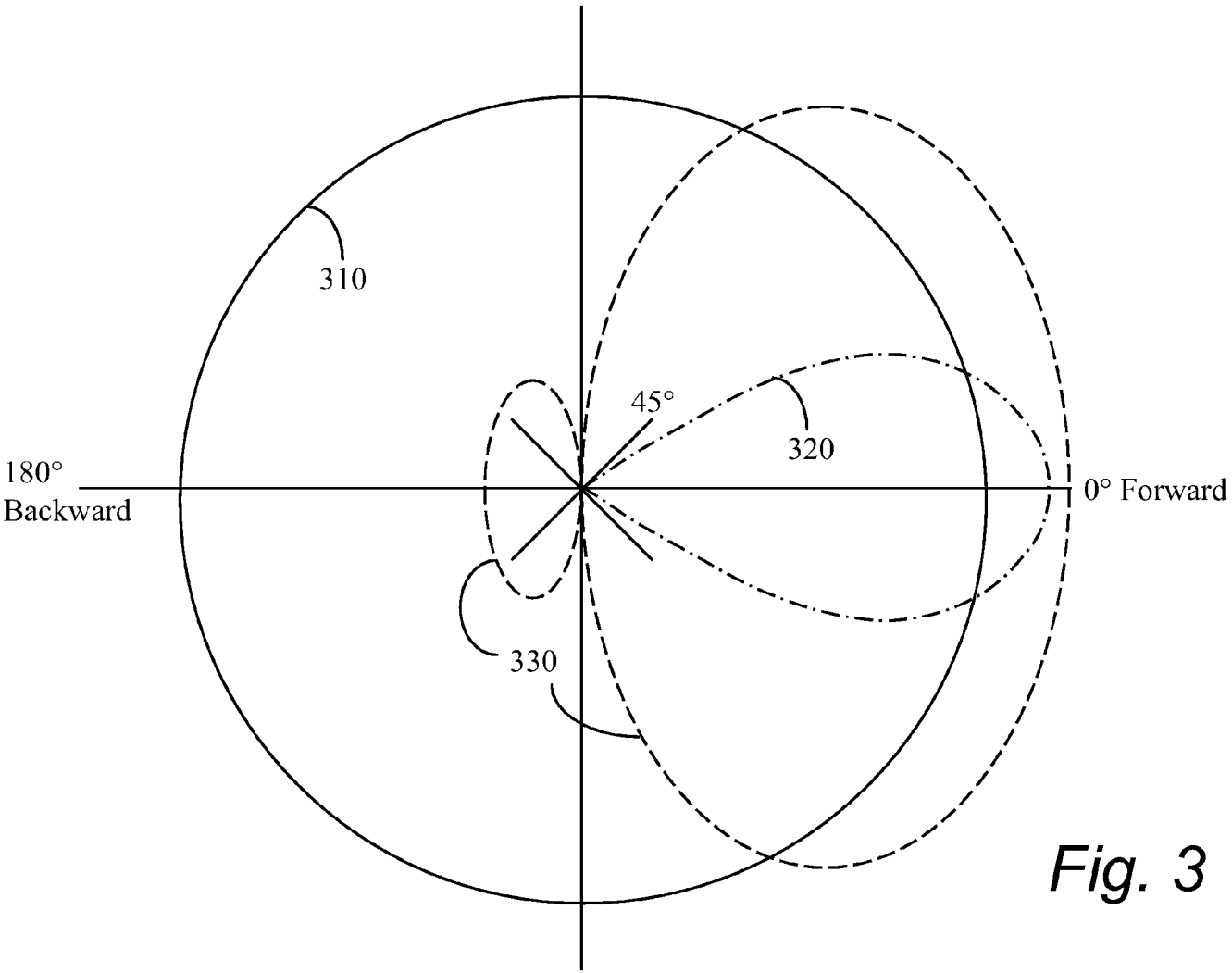
FIG. 3 is a polar plot of lines of constant-energy for alarms with various acoustic lenses.

A polar plot of curves of constant energy emanating from the alarm is shown in FIG. 3. The "forward" direction is the direction of the output of the alarm. Usually, this is the reverse direction for the vehicle on which the alarm is mounted. The solid, circular line 310 depicts the radiation pattern for an alarm having no housing 115 or acoustic lens 210. The intent with this type of alarm is to signal all regions equally. The dot-dashed line 320 shows a typical alarm pattern for an alarm 100 having a 60° horn. The dashed lines 330 approximate an actual radiation pattern for the alarm 100 with the acoustic lens 210 of FIG. 2. The included angle for this design is intended to be near 180°. The difference between the forward and backward sound pressure level is preferably at least 10 dB.

The polar plot of FIG. 3 shows the general characteristics of these alarms 100, but the present invention is not limited to these characteristics.

Figure 4:
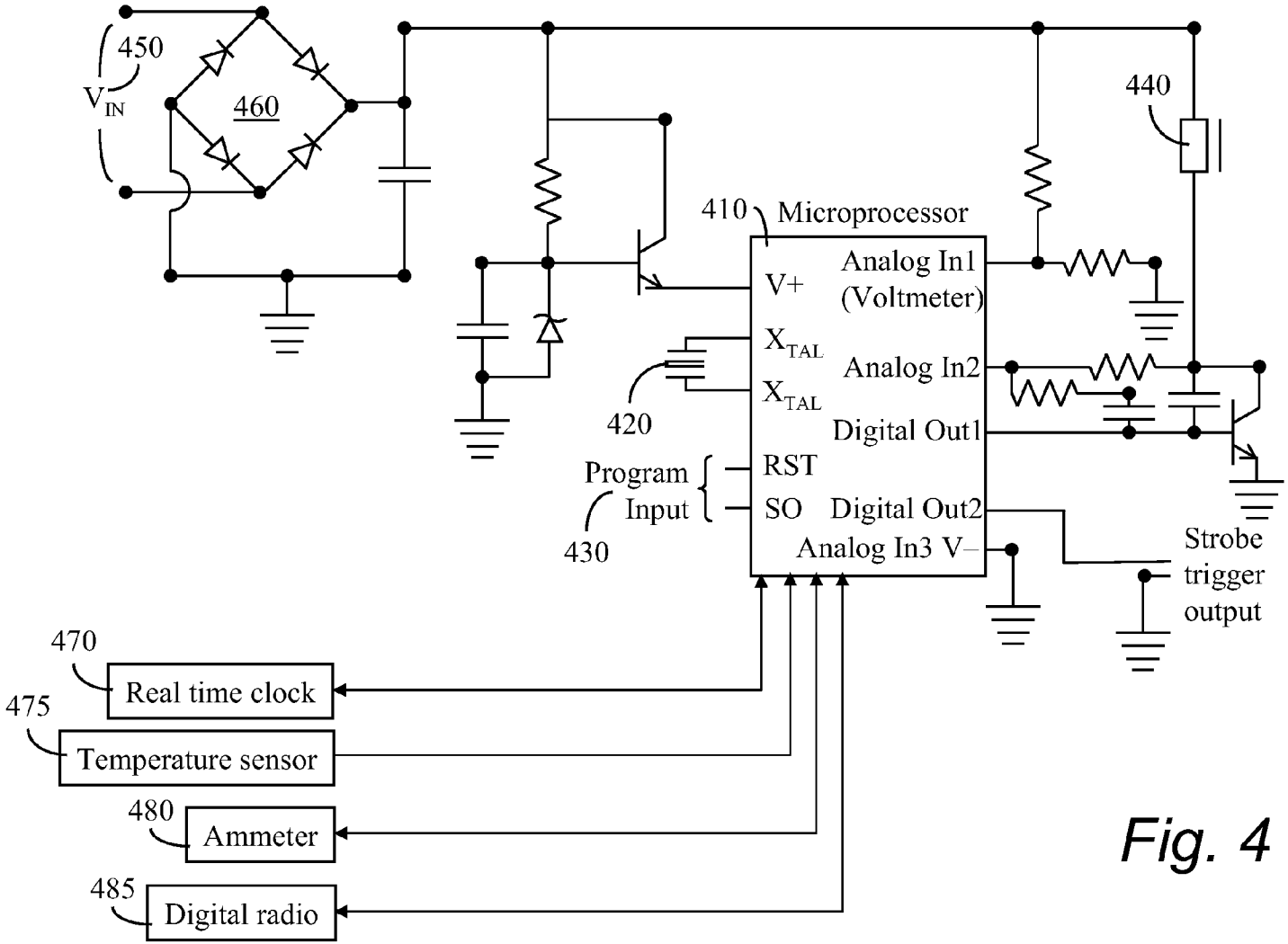
FIG. 4 is a circuit diagram for the alarm system, including the improvements of the present invention.

The transducer 440 shown in FIG. 4 in the alarm 100 may also be used for detecting ambient noise for the purpose of modifying the output of the alarm 100 to be detectible over ambient noise. The directional characteristics shown by the dashed lines 330 of FIG. 3 apply to the sensed ambient sound pressure level as well as the output of the alarm 100.

A typical alarm system circuit diagram is shown in FIG. 4. The central aspect of the circuit is the microprocessor 410. A clock 420 provides timing information to the microprocessor for typical digital circuitry functions. Program input pins 430 permit the microprocessor to be programmed. Programmed aspects include alarm signal characteristics and alarm signal intensity over ambient noise. Preferably, the microprocessor would have the ability to drive the alarm to generate a sound pressure level which is adjustable from 0 to 120 dB.

The pin labeled "Analog In1" detects the voltage available for alarming. The microprocessor 410 can adjust the alarm to offset high or low voltage. Analog In2 receives a signal representing ambient noise from the transducer 440. Digital Out1 is the main alarm signal output, driving the transducer 440 to produce an alarm signal. The transducer would, preferably, have more than one octave of useful bandwidth. Digital Out2 drives an optional strobe for a visible alarm signal.

A range of voltages from 6 to 50 volts DC or 4 to 35 volts AC may be applied at $V_{IN}$ 450. The full bridge rectifier 460 rectifies AC inputs to DC, and permits DC inputs to pass through substantially unchanged.

In some applications, it may be sensible to adjust the signal generated by the alarm 100 according to the time of day. For instance, in a relatively residential location, it may be prudent to reduce alarm volume during night-time hours. For this purpose, a real time clock 470 is provided being connected to the microprocessor 410 via a bidirectional data port.

Figure 5:
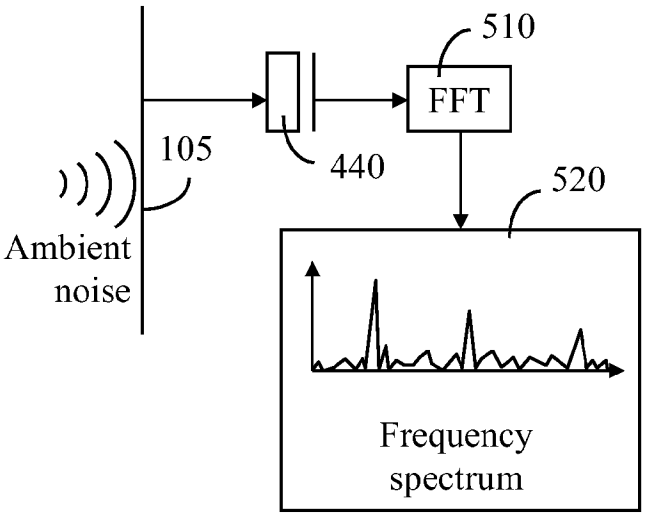
FIG. 5 is a schematic depicting the use of the alarm's diaphragm to detect ambient noise.

As depicted in FIG. 5, using the diaphragm 105, the transducer 440 can be used to sense ambient noise as outlined above. As those of ordinary skill in this art are well aware, the ambient noise signal may be analyzed using a Fast Fourier Transform (FFT) 510 to determine the frequency spectrum 520. From this information, dominant ambient frequencies can be avoided in choosing the alarm frequency or frequencies to help differentiate the alarm signal from ambient noise.

A temperature sensor 475 provides a signal indicating alarm temperature to the microprocessor 410. Alarm performance is a function of temperature. Hence, temperature compensation may be carried out by the microprocessor 410 using the temperature signal.

A feedback signal related to the nominal function of the alarm 100 is obtained from a transducer 440 current sensor or system current sensor 480. With this signal, self diagnostic functions may be carried out within the microprocessor and adjustments made in driving the alarm 100.

Figure 6:
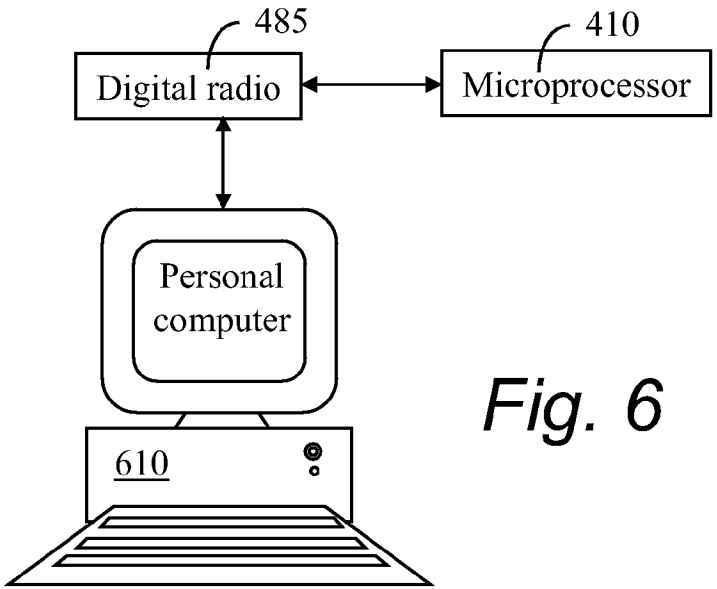
FIG. 6 is a detail of the circuit associated with the digital radio.

A digital radio 485 is interfaced with the microprocessor 410 and a monitoring system such as a personal computer 610, as shown in FIG. 6. A suitable example for the protocol of the digital radio 485 is Bluetooth. Communications between the alarm microprocessor 410 and the monitoring system 610 permit checks on alarm status and archival of alarm function.

The various signals received by the microprocessor 410 are monitored, trended, and alarm life predicted by the monitoring system 610. With this information, replacement can be made prior to alarm failure, thus reducing the chance to encounter a non-operational alarm.

The microprocessor 410 can be used to store identification information such as unique alarm digital ID (serial number) and date of manufacture for warranty and life expectancy. Such data may be used over time to improve alarm life predictions.

The use of the microprocessor 410 greatly increases the flexibility of the alarm 100. Changes in the operation of the alarm 100 may include (A) a new alarm signal; (B) new alarm features and parameters; (C) new alarm operational software; and (D) specialized user specific features.

Also, diagnostics could be built into the wiring harness of OEM equipment and be included in the OEM equipment design. This can be done through the existing program input of the alarm microprocessor 410 and be read by the main vehicle diagnostic tool.

As shown in FIG. 4, the temperature sensor 475 connects to the analog input, while the real time clock 470, the ammeter 480, and the digital radio 485 connect to bidirectional data ports.

The above embodiments are the preferred embodiments, but this invention is not limited thereto. It is, therefore, apparent that many modifications and variations of the present invention are possible in light of the above teachings. It is, therefore, to be understood that within the scope of the appended claims, the invention may be practiced otherwise than as specifically described.

We claim:

1. A method for operating an audible alarm connected to a source of power, the alarm utilizing a microprocessor and accessory selected from a group consisting of a real time clock, an ambient temperature sensor, an ammeter, and a digital radio, the method comprising the steps of:

(a) providing communication between the microprocessor and the accessory;

(b) receiving a signal from the accessory into the microprocessor; and (c) operating the audible alarm based on the signal received into the microprocessor; wherein the alarm includes a transducer for detecting ambient noise, the method additionally comprising the steps of:

(d) detecting ambient noise with the transducer;

(e) determining frequency spectrum of an ambient noise signal; and (f) adjusting an alarm output frequency based on the frequency spectrum of the ambient noise signal, wherein adjusting an alarm output frequency based on the frequency spectrum of the ambient noise signal comprises:

(g) determining dominant frequencies of the ambient noise frequency spectrum; and (h) setting the alarm output frequency to a frequency at least one-third octave outside any determined dominant frequencies.

* * * * *